US005161942A

United States Patent [19]

Chen et al.

[11] Patent Number: 5,161,942

[45] Date of Patent: Nov. 10, 1992

[54] MOISTURE DRAINAGE OF HONEYCOMB SEALS

[75] Inventors: Shun Chen, Winter Springs; David H. Evans, Lake Mary; Manuel I. Llaneras, Winter Park; Ashok T. Patel, Orlando; George J. Silvestri, Jr., Winter Park, all of Fla.

[73] Assignee: Westinghouse Electric Corp., Pittsburgh, Pa.

[21] Appl. No.: 603,036

[22] Filed: Oct. 24, 1990

[51] Int. Cl.[5] ..... F01D 25/32

[52] U.S. Cl. ..... 415/169.2; 277/53; 277/71

[58] Field of Search ..... 415/169.1, 169.2, 169.3, 415/169.4, 914; 277/71.53

[56] References Cited

U.S. PATENT DOCUMENTS

| | | | |
|---|---|---|---|
| 1,829,674 | 10/1931 | Rosenlocher | 415/169.4 |
| 3,365,172 | 1/1968 | McDonough et al. | 415/914 |
| 3,881,842 | 5/1975 | Kosyak et al. | 415/169.3 |
| 4,085,941 | 4/1978 | Wilkinson et al. | 277/71 |
| 4,157,880 | 6/1979 | Klompas | 415/169.4 |
| 4,193,603 | 3/1980 | Sood | 277/53 |
| 4,416,457 | 11/1983 | McGinnis et al. | 415/112 |
| 4,948,335 | 8/1990 | Silvestri, Jr. | 415/169.2 |
| 5,037,114 | 8/1991 | Gray | 277/53 |

FOREIGN PATENT DOCUMENTS

| | | | |
|---|---|---|---|
| 789056 | 10/1935 | France | 277/71 |
| 1470121 | 2/1967 | France | 277/71 |

*Primary Examiner*—John T. Kwon

[57] ABSTRACT

A honeycomb seal cooperatively associated with a rotatable blade of a steam turbine having a cylinder, seal include a backing plate fixedly connected to a mounting portion of the cylinder, the mounting portion having an associated moisture removal channel. A plurality of rows of honeycomb cells extend radially inwardly from the backing plate so that each cell is open adjacent said blades. The said backing plate is perforated with at least one perforation for each honeycomb cell for communicating moisture collected in the honeycomb cells to the moisture removal channel of the mounting portion of the cylinder.

16 Claims, 4 Drawing Sheets

MOISTURE DRAINAGE OF HONEYCOMB SEALS

BACKGROUND OF THE INVENTION

1. Field of the Invention

The present invention relates generally to honeycomb labyrinth seals used in steam turbines and, more specifically, to an improved moisture drainage provided for honeycomb seals.

2. Description of the Related Art

A honeycomb labyrinth seal used in conjunction with rotatable steam turbine blades is described in U.S. Pat. No. 4,416,457, issued to McGinnis et al. FIGS. 1 and 2 of the aforesaid patent have been reproduced herein in order to illustrate the prior art.

Referring to FIGS. 1 and 2, a tip of a rotatable steam turbine blade 1 is disposed adjacent a honeycomb labyrinth seal 3 which fits into a circumferential groove 4 in an inner cylinder or blade ring 5. The seal 3 is formed as a plurality of arcuate segments. Each segment includes a base portion 7 and a plurality of rows of honeycomb cells 9 extending radially inwardly from the base portion so that each cell is open adjacent the blades 1. A plurality of passages or grooves are so disposed that each cell 9 is connected to at least one passage.

The seal illustrated in FIGS. 1 and 2 provides a sealing device which when located at a rotating blade tip serves as a collector for liquid droplets discharged from the rotating blade through centrifugal action and permits drainage through the grooves 11 to a gap 13 disposed between circumferentially adjacent honeycomb labyrinth seal segments. The water then moves to a drain. Drainage of the liquid is important in order to minimize the possibility of reentrainment in the path of the rotating blades in order to minimize the possibility of blade tip erosion resulting from reentrainment. However, the drainage flow is substantially in a downstream direction resulting from axial pressure gradient imposed by the blade passage flow field conditions.

Low pressure turbines are designed to incorporate as many features as possible which lead to reduced erosion. The entire turbine geometry exposed to steam flow has an effect on moisture collection and removal. For example, one feature is to increase the axial spacing between a stationary row and the next adjacent rotating row.

While various features have been implemented, there is still room for improvement. For example, water accumulated in the honeycomb seal which finally leaves the last row of honeycomb cells may dribble back into the blade path, meaning that a significant fraction of the collected water will become reentrained.

While it has been considered to shorten the length of the honeycomb on the downstream side so that the rotating blade extends beyond the honeycomb, this would result in significant efficiency losses because of the pressure difference between the pressure and suction sides of the blade.

FIG. 3 shows an enlarged sectional view of a known turbine showing a stationary blade of the L-OC row, a rotating blade of the L-IR row, and a stationary blade of the L-IC row. Prior attempts to collect moisture have focused on ways to have water slung off the trailing edge of the L-1R rotating blade pass unimpeded into a moisture drainage cavity 2. However, these attempts have not been completely successful, partially because the drain path is somewhat convoluted.

SUMMARY OF THE INVENTION

An object of the present invention is to improve moisture drainage of honeycomb seals cooperatively associated with rotary blades of a steam turbine.

Another object of the present invention is to prevent the reentrainment of moisture collected by honeycomb seals, thereby reducing downstream erosion without impairing the performance of the rotating blade that is being sealed.

Another object is to provide the most direct drainage paths as possible for moisture collected by honeycomb seals.

These and other objects of the present invention are met by providing a honeycomb seal cooperatively associated with rotatable blades of a steam turbine having a cylinder, the seal including a backing plate fixedly connected to a mounting portion of the cylinder, the mounting portion having an associated moisture removal channel, and a plurality of rows of honeycomb cells extending radially inwardly from the backing plate so that each cell is open adjacent the blades, the backing plate being perforated with at least one perforation for each honeycomb cell for communicating moisture collected in the honeycomb cells to the moisture removal channel of the mounting portion of the cylinder.

In another aspect of the present invention, a moisture drainage system for use in a steam turbine having a cylinder and a row of rotary blades includes a backing plate fixedly connected to the cylinder over the row of rotating blades, a plurality of rows of honeycomb cells extending inwardly from the backing plate so that each cell is open adjacent the row of rotary blades, a plurality of perforations extending in the direction of the honeycomb cells and being formed in the backing plate with at least one perforation provided under each honeycomb cell, and radial passage means provided in the cylinder in communication with the perforations and extending in the direction of the perforations for removing moisture collected by the honeycomb cells. Preferably, the radial passage means includes a collection chamber formed annularly in the cylinder over the rotating blades for receiving moisture collected by the honeycomb cells.

These and other features and advantages of the improved moisture drainage of honeycomb seals of the present invention will become more apparent with reference to the following detailed description and drawings.

DETAILED DESCRIPTION OF THE PREFERRED EMBODIMENTS

Steam turbines are known to include several rows or stages of rotary blades mounted on a rotor, and several rows of stationary blades mounted on a cylinder which surrounds the rotor. The stationary blades and rotary blades are alternatingly disposed so that the tips of the rotor blades are sealed against the cylinder, while the stationary blades are sealed against the rotor. The present invention relates to a honeycomb seal which is cooperatively associated with a rotary blade of a steamed turbine, and to a moisture drainage system which incorporates the seal.

The blades of a given row are substantially identical, and the shape of the blades of one row differ from the shape of the blades of the other rows.

Figure 4:
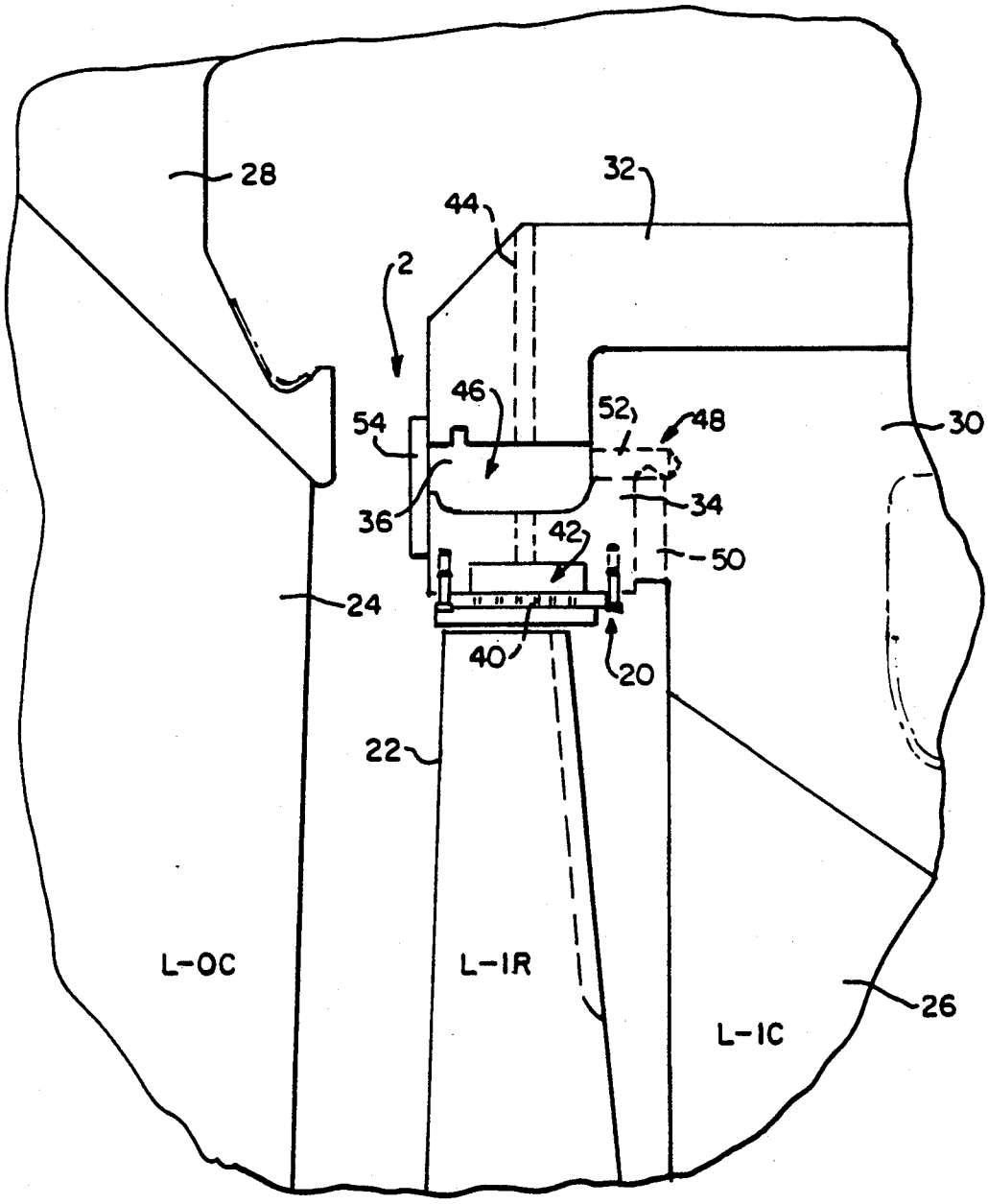
FIG. 4 is a side elevational view, partly in section, of a portion of a steam turbine showing a moisture drainage system and honeycomb seal according to the present invention.
Figure 5:
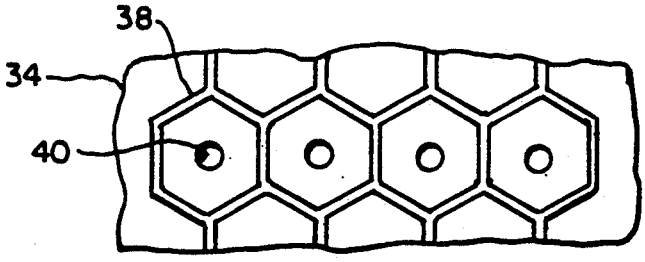
FIG. 5 is a partial sectional view similar to FIG. 2, but showing the perforations of the backing plate according to the present invention.

The present invention is illustrated in FIG. 4 with reference to a seal 20 which is cooperatively associated with the L-1R row, and in particular, the blade tips of the rotary blades of the L-1R row of rotary blades. However, the honeycomb seal described herein, as well as the moisture drainage system incorporating the same, can apply to any other honeycomb seal similarly adapted for use in a steam turbine. In FIG. 4, the tip of the rotary blade 22, as well as the tips of other blades of the same row, is sealed by the honeycomb seal 20. The seal 20 has the basic construction of the honeycomb seal described in U.S. Pat. No. 4,416,457, in that it is preferably made in segments which are arcuately disposed around the row of rotating blades so as to provide a 360° seal.

Adjacent stationary blades 24 and 26 are shown on either side of the rotary blade 22. Stationary blade 26 is upstream of rotary blade 22, while stationary blade 24 is downstream. Each stationary blade is mounted to an inner cylinder of the steam turbine cylinder by outer ring segments 28 and 30, respectively. The outer ring segments are attached to the inner cylinder 32 by using known techniques, such as caulking. When so assembled, the outer ring segments may be considered part of the inner cylinder for the purposes of the discussion which follows.

A backing plate 34 is fixedly connected to a mounting portion of the cylinder. In the illustrated embodiment, the mounting portion of the cylinder is actually an extended flange 36 of the outer ring segment 30. However, with a different configuration, the mounting portion could actually be a part of the inner cylinder 32; thus, it is convenient to speak of the outer ring segments as being part of the inner cylinder.

The backing plate 34 (or backing plates in the segmental assembly) carries a plurality of rows of honeycomb cells 38 which extend radially inwardly from the backing plate 34 so that each cell is open adjacent the tips of the rotary blades 22. The backing plate 34 is perforated with a plurality of perforations 40. Preferably, there is at least one perforation for each honeycomb cell for communicating moisture collected in the honeycomb cells to a moisture removal channel of the mounting portion of the cylinder (to be described below). The exact number and size of the perforations 40 can be selected on the basis of the expected amount of moisture collected by the honeycomb cells.

In FIG. 4, the backing plate 34 is fixedly connected to the flange 36 of the outer ring segment 30 by any suitable means, such as threaded fasteners. The honeycomb cells are connected to the backing plate in the typical fashion which usually involves brazing. The perforations 40 extend in the direction of the honeycomb cells so that both cells and the perforations are radially disposed and parallel to each other.

Radial passage means are disposed on the side of the backing plate 34 opposite the tips of the rotary blades 22. The radial passage means is in communication with the perforations and extends in the direction of the perforations so as to remove moisture collected by the honeycomb cells in a flow path which is substantially radial. The radial passage means includes a collection chamber 42 which is formed annularly in the mounting portion of the cylinder, such as in the flange 36, and extends in the direction of the perforations 40 for removing moisture collected by the honeycomb cells 38. Thus, the collection chamber 42 should have a width which extends across the width of the honeycomb cell-portion of the seal, and should be wide enough to underlie all of the perforations.

A plurality of radial drain holes 44 are provided in the flange 36 and extend through the inner cylinder 32 to the moisture drainage cavity 2 of the cylinder. Thus, the radial drain holes, in the illustrated embodiment of FIG. 4, have two portions: one portion extends through the flange 36 while the other portion extends through the inner cylinder 32. In other embodiments where there is no flange, and thus no space 46 between the inner cylinder 32 and the flange 36, the radial drain holes 44 would be continuously formed through the inner cylinder 32.

The size and number of drain holes 44 will be determined by the expected amount of moisture flow, and thus, the number and size would be selected to adequately remove the volume of moisture expected to be collected. In many existing turbines, a drain channel 48 is provided between the trailing edge of the upstream stationary blade 26 and the leading edge of the rotary blade 22. This channel, in the configuration of FIG. 4, includes a radial portion 50 and an axial portion 52. Normally, moisture collected by the drain channel 48 passes through the space 46 and exits in a substantially axial direction on its way towards the drainage cavity 2. Water jetting out of this axial leg of the drain channel 48 tends to re-enter the blade path and erode the inlet edge of the outer ring segment 28. If unimpeded, this axial flow of moisture may also impede the radial flow of moisture as it passes through the radial drain holes 44. Thus, in a preferred embodiment of the present invention, a deflector 54 is connected to the flange 36 by any suitable means, such as brazing or welding. The deflector 54 prevents flow in the direction of the steam flow. The deflector plate would be made of an erosion resistant material and would practically seal off the space between the inner cylinder and the outer ring segment 30.

In some designs, the portion of the drain holes 44 which passes through the inner cylinder 32 may have been pre-existing to help drain the space 46. In that case, the drain holes would have to be increased in diameter to accommodate the increased water flow resulting from the discharge of the honeycomb labyrinth seal.

Figure 1:
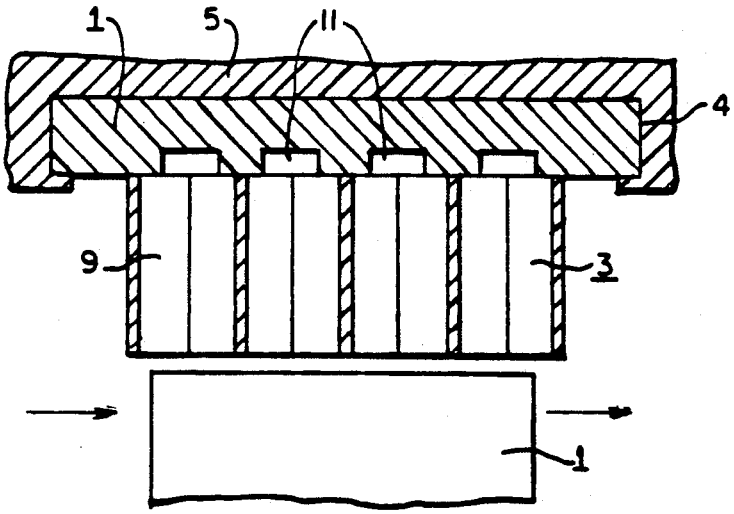
PRIOR ART FIG. 1.
FIG. 1 is a partial sectional view of a known honeycomb labyrinth seal disposed in a portion of a steam turbine.
Figure 2:
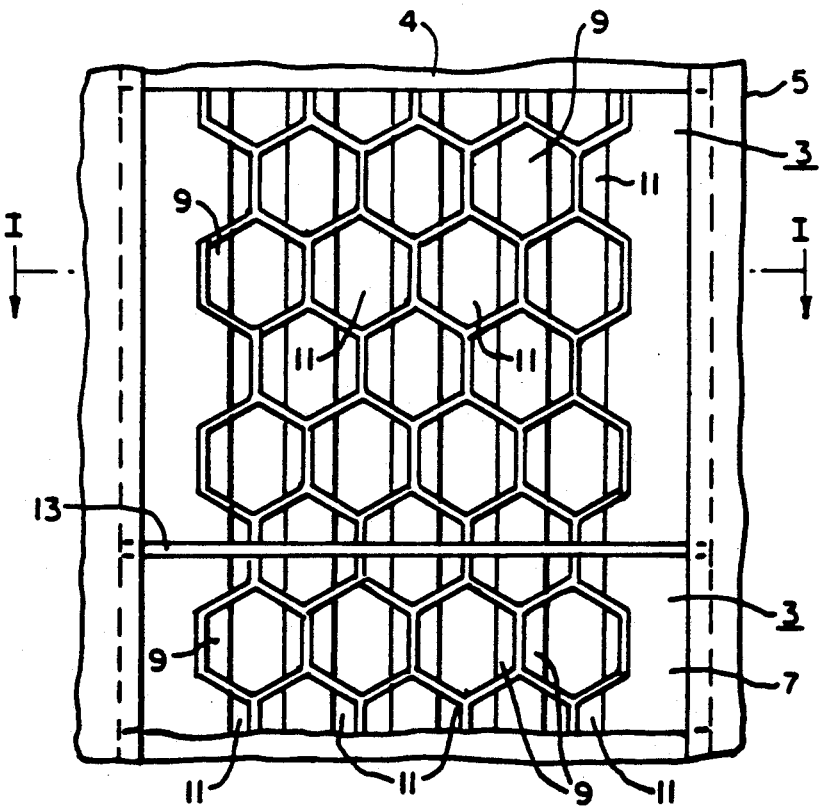
FIG. 2. PRIOR ART
FIG. 2 is a partial sectional view taken along line II—II of FIG. 1.
Figure 3:
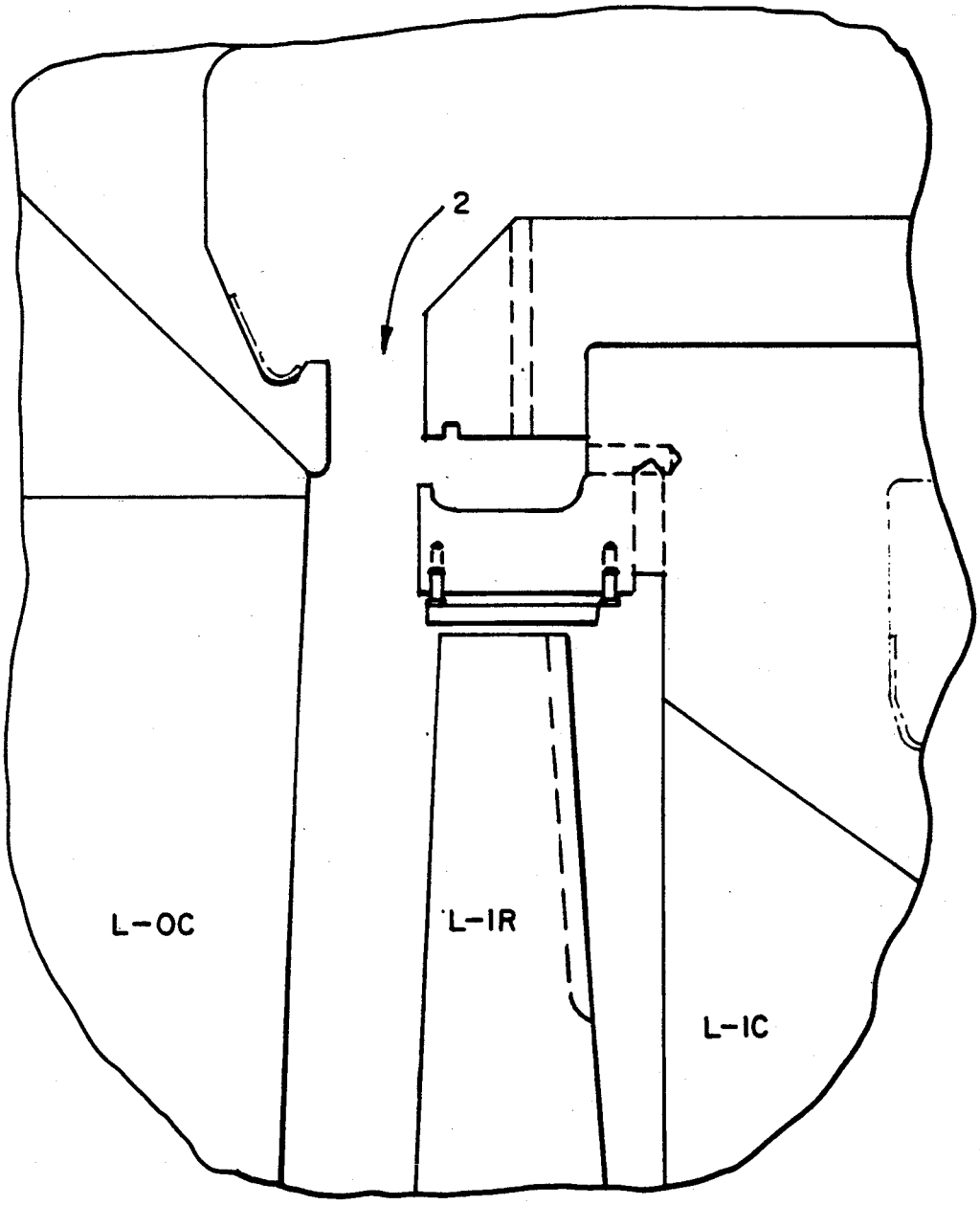
PRIOR ART FIG. 3.
FIG. 3 is a side elevational view, partly in section, showing a portion of a steam turbine in which the labyrinth seal of FIG. 1 is used.
Figure 6:
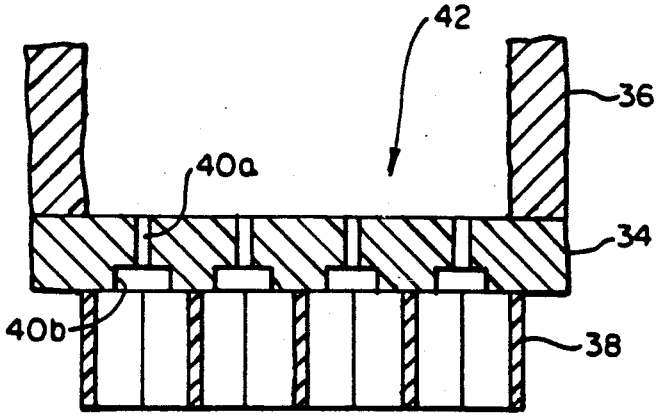
FIG. 6 is a sectional view showing a second, preferred embodiment of the present invention, using a grooved backing plate.
Figure 7:
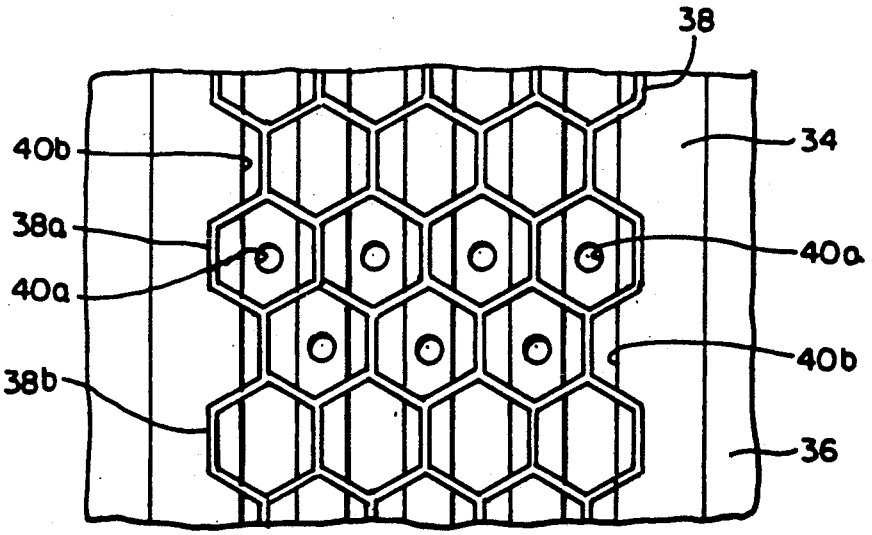
FIG. 7 is a partial plan view showing the embodiment of FIG. 6.

An alternative embodiment is illustrated in FIGS. 6 and 7, in which it becomes unnecessary to provide a perforation under each of the honeycomb cells. In particular, the backing plate 34 is grooved according to the known device illustrated in FIG. 1, and these grooves 40*b* act as manifolds to drain more than one of the cells of a particular row through a common perforation 40*a*. In particular, as shown in FIG. 7, cells 38*a* and 38*b* of the same row are drained through groove 40*b* and the single perforation 40*a*. This arrangement is effective in reducing machining costs, since the number of perforations made by a drilling operation can be reduced. The exact number of perforations, of course, will depend on the expected amount of flow. However, it is clear from the embodiment of FIGS. 6 and 7 that it is no longer necessary to have at least one perforation for each honeycomb cell.

Numerous modifications and adaptations of the present invention will be apparent to those so skilled in the art and thus, it is intended by the following claims to cover all such modifications and adaptations which fall within the true spirit and scope of the invention.

We claim:

1. A moisture drainage system for use in a steam turbine having a row of rotary blades, said system comprising:

a plurality of rows of honeycomb cells, each cell having a first end and a second end, the second end being open and opposite the first end, the honeycomb cells extending radially outwardly from the rotary blades so that the second ends are open adjacent the rotary blades;

an annular backing plate connected to the first ends of the honeycomb cells and located radially outwardly from the honeycomb cells;

an annular cylinder having a drainage cavity and a mounting portion, the cylinder being located radially outwardly from the backing plate with the backing plate fixedly connected to the mounting portion; and means, passing through the backing plate, for communicating moisture collected in the honeycomb cells to the moisture drainage cavity of the cylinder.

2. A moisture drainage system as recited in claim 1, wherein the communicating means comprises a plurality of radial perforations formed in the backing plate.

3. A moisture drainage system as recited in claim 2, wherein the backing plate has a plurality of grooves in communication with the first ends of the honeycomb cells, the plurality of perforations being formed in the grooves.

4. A moisture drainage system for use in a steam turbine having a row of rotary blades, the system comprising:

a plurality of rows of honeycomb cells, each cell having a first end and a second end, the second end being open and opposite the first end, the honeycomb cells extending radially outwardly from the rotary blades so that the second ends are open adjacent said row of rotary blades;

an annular backing plate connected to the first ends of the honeycomb cells and located radially outwardly from the honeycomb cells;

an annular cylinder having a drainage cavity and a mounting portion, the cylinder being located radially outwardly from the backing plate with the backing plate fixedly connected to the mounting portion;

means, passing through the backing plate, for communicating moisture collected in the honeycomb cells to the moisture drainage cavity of the cylinder, and radial passage means for removing moisture collected in the honeycomb cells, the radial passage means being provided in the cylinder and extending radially outwardly from the rotary blades.

5. A moisture drainage system as recited in claim 4, wherein the communicating means comprises a plurality of radial perforations formed in the backing plate.

6. A moisture drainage system as recited in claim 5, wherein the radial passage means includes a collection chamber formed annularly in the cylinder radially outwardly from the backing plate, and in communication with the means passing through the backing plate so as to receive moisture collected by said honeycomb cells.

7. A moisture drainage system according to claim 4, wherein the radial passage means includes a collection chamber formed annularly in the cylinder radially outwardly from the backing plate, and in communication with the means passing through the backing plate so as to receive moisture collected by said honeycomb cells.

8. A moisture drainage system as recited in claim 7, wherein the radial passage means further includes a plurality of radial drain holes formed in the cylinder radially outwardly from the collection chamber, the radial drain holes being in communication with the collection chamber and extending to the moisture drainage cavity of the cylinder.

9. A moisture drainage system as recited in claim 8, wherein the backing plate is formed in plural segments around the row of rotary blades, the collection chamber is an annular groove formed in the cylinder, and the plurality of radial drain holes extend from a bottom of the collection chamber to the moisture drainage cavity of the cylinder in a radial direction.

10. A moisture drainage system according to claim 4, wherein the cylinder carries two rows of stationary blades, a first row on the upstream side of the row of rotary blades and a second row on the downstream side of the row of rotary blades, the cylinder includes a drainage space and a drain channel formed between a downstream edge of the blades of the second row of stationary blades and an upstream edge of the blades of the row of rotary blades, the drain channel having a radial portion and an axial portion, the axial portion extending to the drainage cavity.

11. A moisture drainage system according to claim 10, further comprising a deflector plate connected to the cylinder over the drainage space to divert moisture passing through the drain channel outwardly through the radial passage means.

12. A moisture drainage system for use in a steam turbine having a row of rotary blades, the system comprising:

a plurality of rows of honeycomb cells, each cell having a first end and a second end, the second end being open and opposite the first end, the honeycomb cells extending radially outwardly from the rotary blades so that the second ends are open adjacent the row of rotary blades;

an annular backing plate connected to the first ends of the honeycomb cells and located radially outwardly from the honeycomb cells;

an annular cylinder having an annular collection chamber, and a mounting portion, the cylinder being located radially outwardly from the backing plate with the backing plate fixedly connected to the mounting portion;

a plurality of perforations formed in the backing plate for communicating moisture collected in the honeycomb cells to the collection chamber and extending radially outwardly from the honeycomb cells with at least one perforation provided under each honeycomb cell; and radial passage means provided in the cylinder, and extending radially outwardly from the collection chamber to a moisture draining cavity of the cylinder.

13. A moisture drainage system as recited in claim 12, wherein the radial passage means includes a plurality of radial drain holes formed in the cylinder and being in communication with the collection chamber.

14. A moisture drainage system according to claim 12, wherein the cylinder further comprises:

two rows of stationary blades, a first row on the upstream side of the row of rotary blades and a second row on the downstream side of the row of rotary blades;

the cylinder includes a drainage space and a drain channel formed between a downstream edge of the blades of the second row of stationary blades and an upstream edge of the blades of the row of rotary blades, the drain channel having a radial portion and an axial portion, the axial portion extending to the drainage space.

15. A moisture drainage system according to claim 14, further comprising a deflector plate connected to the cylinder over the drainage space to divert moisture passing through the drain channel outwardly through the radial passage means.

16. A moisture drainage system as recited in claim 15, wherein the backing plate is formed in plural segments around the row of rotary blades, the collection chamber is an annular groove formed in the cylinder, and the radial passage means comprises a plurality of radial drain holes extending from a bottom of the collection chamber to the moisture drainage cavity of the cylinder in a radial direction.

* * * * *